US006688028B2

(12) United States Patent
Backe

(10) Patent No.: US 6,688,028 B2
(45) Date of Patent: Feb. 10, 2004

(54) CONDITION RESPONSIVE TRAFFIC SIGN

(76) Inventor: Bruce H. Backe, 577 Woodland Dr., Crystal Lake, IL (US) 60014

( * ) Notice: Subject to any disclaimer, the term of this patent is extended or adjusted under 35 U.S.C. 154(b) by 76 days.

(21) Appl. No.: 10/010,555

(22) Filed: Nov. 8, 2001

(65) Prior Publication Data

US 2002/0073586 A1 Jun. 20, 2002

Related U.S. Application Data

(60) Provisional application No. 60/247,653, filed on Nov. 9, 2000.

(51) Int. Cl.[7] ..... G09F 19/00
(52) U.S. Cl. ..... 40/612; 40/492; 40/466
(58) Field of Search ..... 40/612, 588, 590, 40/492, 575, 466

(56) References Cited

U.S. PATENT DOCUMENTS

| | | | |
|---|---|---|---|
| 1,559,605 | A | 11/1925 | Ginger |
| 1,685,080 | A | 9/1928 | Auchincloss |
| 3,111,782 | A | 11/1963 | Quigley |
| 3,863,214 | A | 1/1975 | Kerr, Jr. |
| 4,642,605 | A | 2/1987 | Karp |
| 5,504,481 | A | 4/1996 | Wys |
| 5,819,455 | A | 10/1998 | Tsuda |

*Primary Examiner*—Lesley D. Morris
*Assistant Examiner*—Motilal P. Patel
(74) *Attorney, Agent, or Firm*—Sherman D. Pernia

(57) ABSTRACT

A vertically disposed placard has two sections, one disposed over the other, with the upper section of the placard attached to a pole, standard or other mount. A hinge connects the bottom perimeter edge of the fixed section with the top perimeter edge of the lower, pivotable section, allowing the front surface of the pivotable section to rotate and fold flat against the front surface of the upper, fixed section. A catch mechanism releaseably holds the two sections flat against each other, preventing the pivotable section from unfolding. An electrical controller is attached to the back surface of the fixed section of the placard and senses when a condition to which the sign is responsive occurs. Upon the occurrence, the controller causes release of the catch mechanism, allowing the pivotable section to unfold under the force of a bias (e.g., spring) and/or gravity, or by an electric motive mechanism to display the front surfaces of both sections of the placard. When the condition no longer exists, the device may be returned to its folded configuration manually or electromotively (if so equipped). When the placard is unfolded, the front surfaces of the placard together display a first sign item, and when the placard is folded, the back surface of the pivotable section is presented and can display a second sign item. Therefore, alternative sign items may be displayed, depending on whether the sections of the placard are folded or unfolded.

20 Claims, 10 Drawing Sheets

CONDITION RESPONSIVE TRAFFIC SIGN

The present application claims the benefit of prior filed Provisional Application, Ser. No. 60/247,653 filed Nov. 9, 2000, to which the present application is a regular U.S. national application.

FIELD OF THE INVENTION

The present invention relates to the field of sign exhibiting and traffic control. More specifically, the present invention relates to signs having hinge mounted display items wherein the display items are supported by means permitting rotation along one margin thereof to facilitate exposure of the item to be displayed upon occurrence of a condition in the environment.

BACKGROUND OF THE INVENTION

The orderly and safe flow of vehicular traffic is dependent on the proper functioning of a variety of traffic control devices. Traffic control devices range in complexity from simple placard-type signs to combination electric signal lights and vehicle sensors. The development and use of this variety of display devices is not just to control the flow of traffic, but also to advise of hazardous road conditions, such as curves, construction, road icing and the like. However, most display devices are static, in that they do not automatically sense and respond to an unplanned change in a condition of their environment which could impact the orderly flow of traffic or represent a new hazard.

The field has been and continues to be motivated to provide condition responsive traffic control devices. Typical examples of such devices include variable timer circuits preset to control signal light cycling intervals according to expected rush-hour and non rush-hour traffic volumes, and embedded road surface vehicle sensors for initiating a signal light cycle. Generally, these condition responsive control devices respond to an unplanned change in the condition of the environment, such as a power outage, flooding, freezing temperature or the like. Specialty traffic control devices have been developed to try to address the problem of certain unplanned changes in the environment which affect the orderly flow of traffic or represent potential hazards. For example, Wys (U.S. Pat. No. 5,504,481) is a recent patent for a "fail-safe" stop light apparatus which covers the face of a traffic light with a warning sign when electrical power to the light fails. Upon restoration of power, the Wys device retracts to uncover the face of the light. The Wys device is relatively complex and requires two separate biasing and electromagnetic latching mechanisms to accomplish its utility. Kerr, Jr. (U.S. Pat. No. 3,863,214) is an earlier example of a device designed to address the same problem of a power outage to a traffic signal light. The Kerr device deploys a placard mounted at the end of a pivot arm from behind the signal light when power fails, displaying an alternative traffic control sign. Another example of a traffic control device responsive to a loss of electrical power to a signal light is disclosed by Karp (U.S. Pat. No. 4,642,605). The Karp device is relatively simple, but unlike the Wys and Kerr devices, it in not taught as retracting after power is restored to the signal light.

Each of the Wys, Kerr and Karp devices are useful for their stated purpose. However, the only condition to which they are automatically responsive is presence or absence of electrical power. Additionally, each of these devices is also required to be physically attached to the traffic signal light for which they serve as an alternative display device. It would be beneficial to have a relatively simple traffic control device that can be readily adapted to automatically respond to a variety of environmental conditions (in addition to loss of electrical power), and can be mounted and displayed other than physically attached to a traffic signal light.

SUMMARY OF THE INVENTION

The present invention is a condition responsive traffic sign device for directing pedestrian and/or vehicular traffic. The present device presents alternative sign items depending on a condition in the environment in which it is posted, a sign item being an advisory message or symbol for display to vehicular and/or pedestrian traffic in the area.

The present device is comprised of a vertically disposed placard. The placard has two sections, one disposed over the other. The upper section of the placard is a "fixed" section. It is fixed in that it is the section of the placard that is attached to the pole, standard or other mount on which the device is posted. The lower section of the placard is a "pivotable" section. Each section has a perimeter edge, and front surface and back surfaces. A pivot mechanism connects the bottom perimeter edge of the fixed section with the top perimeter edge of the pivotable section. The pivot mechanism allows the front surface of the pivotable section to rotate and fold flat against the front surface of the fixed section. A catch mechanism is disposed between the fixed section and the pivotable section. The catch mechanism releaseably holds the front surface of the pivotable section against a bias flat against the front surface of the fixed section, preventing the pivotable section from unfolding under the force of the bias. A controller is attached to the back surface of the fixed section of the placard. The controller may be mechanically operated, electric powered, or a combination of the two. The controller senses when the condition to which the sign is responsive occurs, and then releases the catch mechanism from holding the pivotable section flat against the fixed section. This allows the pivotable section to unfold under the force of the bias to display the front surfaces of both sections of the placard substantially aligned in a vertical plane. An electrical power source is operatively connected to the controller. A mounting means is also disposed on the back surface of the fixed section. The mounting means attaches the fixed section of the placard in a proximately vertical orientation to a pole, standard or other suitable mount.

When the placard is in an unfolded configuration, the front surfaces of the fixed and pivotable sections of the placard together display a first sign item. However, when the placard is in its folded configuration, it is the back surface of the pivotable section that is presented and can display a second sign item. Therefore, alternative sign items may be displayed, depending on whether the sections of the placard are folded or unfolded.

The pivot mechanism may be accomplished by any of a number of means known to one of ordinary skill in the art. Typically, a pivot means comprises the fixed and pivotable section of the placard being interconnected by at least one mutual rod or pin about which the sections are rotatable. For example, any of a variety of hinges are selectable and adaptable for practice of the pivot means for interconnecting the fixed and pivotable sections of the placard. The pivot mechanism may further include a spring to bias the pivotable section of the placard relative to the fixed section in an unfolded configuration. Other means for biasing the pivotable section of the placard relative to the fixed section in an unfolded configuration may be included in the present device. The purpose of this biasing means is to facilitate the initial unfolding of the two sections of the placard relative to each other. Depending on the type of pivot mechanism used, if the device has not been activated in a long time, the pivot may not operate as freely as desired, and an initial bias to facilitate its operation could be beneficial. Additionally, in inclement weather, icing of the folded surfaces may occur, and an initial bias to break any adhesion of the folded surfaces may facilitate the operation of the device.

The catch mechanism comprises a latch and catch combination. The latch is mounted on one section of the placard and the catch is mounted on the other. The latch on one section is disposed to releaseably engage the catch on the other section and prevent the rotation of the sections about the pivot mechanism. Typically, the latch is mounted on the fixed section of the placard and the catch is on the pivotable section of the placard. The catch mechanism may be electrically or mechanically operated to cause the latch to disengage the catch. Examples of catch mechanisms adaptable for practice in the present invention include catch and pawl combinations, which may be either mechanically or electrically operated, and electromagnets. Catch mechanisms are known in the art and are selectable by the ordinary skilled artisan for practice in the present invention.

The controller detects or senses the condition to which the sign is responsive. The controller may inherently detect the condition (such as loss of power), or it may include an actuator/sensor combination for this purpose. Upon detecting the condition, the controller releases the catch mechanism and allows the pivotable section to unfold to display the front surfaces of both sections of the placard. The controller may be designed to operate mechanically or electro-mechanically, depending on the condition to which the controller is responsive and the design of the means of detecting the condition. The controller is in operative communication with the catch mechanism and acts to release the catch mechanism upon detecting the condition to which the sign is responsive. Where the controller comprises an actuator/sensor combination, the actuator feature is in operative communication with the sensor and the catch mechanism, the actuator for releasing the catch mechanism in response to the sensor detecting a condition to which the sign is responsive.

Typically, the condition to which the present device is responsive is a change in the environment of the sign. Changes in the environment of the sign to which the controller may be responsive include temperature, electrical power, electrical parameter and signal transmission, and moisture. For example, the controller may detect or sense a loss of electrical power, a drop in temperature below freezing, moisture (precipitation) or water (flooding) in the environment, or the presence of an activation signal transmission.

An electrical power source is operatively connected to the controller in those embodiments of the present invention wherein the controller is electro-mechanical. The power source provides electrical power to the controller to energize those features and functions of the controller that require electricity. The power source can be as simple as a connection to an external electrical line, it can be an internal power supply circuit, or a combination of the two. An example of an internal power supply circuit is the combination of a solar panel with a charging circuit and a storage battery. An example of a combination power source is a charging circuit and a storage battery combined with a switching circuit connected to an external electrical line.

The present invention includes a means of mounting the device to a pole, sign standard or other sign posting means. The mounting means may be accomplished by utilizing any of a number of methods and fasteners known to one of ordinary skill in the art, including bolts, screws, straps and other types of fasteners. Typically, in accomplishing the mounting means, a fastener is combined with a standoff at the back surface of the fixed section for attaching the device to a pole or standard. The housing of the controller my serve as a standoff for attaching the device to a pole or standard. Additionally, when gravity provides bias for unfolding the sections of the placard, the standoff is disposed to mount the fixed section of the placard in an orientation that is sufficiently inclined from vertical to allow gravity to bias the pivotable section to rotate away from the fixed section when the catch mechanism is released.

Optionally, a folding mechanism may be incorporated into the present device. The folding mechanism comprises a motor assembly to rotate the pivotable section and fold it flat against the fixed section, causing the catch mechanism to re-engage. The folding mechanism is activated upon termination of the condition to which the sign is responsive.

As a further option, the present condition responsive traffic sign can include an electrically powered light source disposed on the front surface of the placard and operatively connected to the power source via the controller. The light source would be energized upon the controller releasing the catch mechanism and displayed at the front surfaces of the unfolded sections of the placard.

DETAILED DESCRIPTION OF THE INVENTION

Figure 1A:
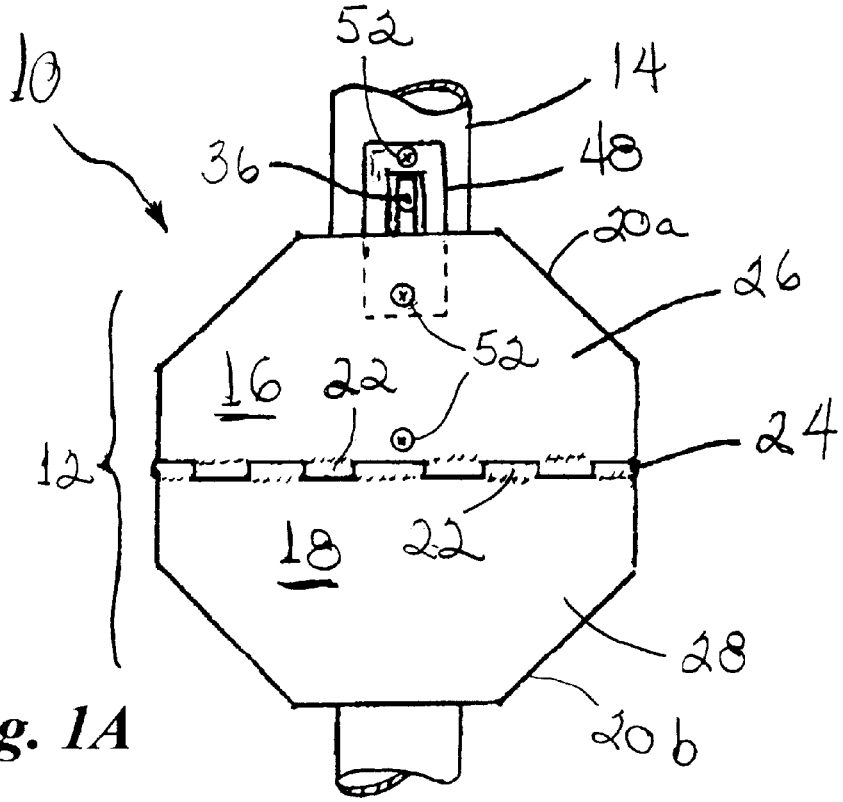
FIG. 1A is a front elevation view of a condition responsive traffic sign device of the present invention shown attached to a pole in an unfolded configuration, with the two placard sections disposed to display a first sign item on their combined front surfaces.

Referring now to the drawings, the details of preferred embodiments of the present invention are graphically and schematically illustrated. Like elements in the drawings will be represented by like numbers, and any similar elements will be represented by like numbers with a different lower case letter suffix.

Figure 1B:
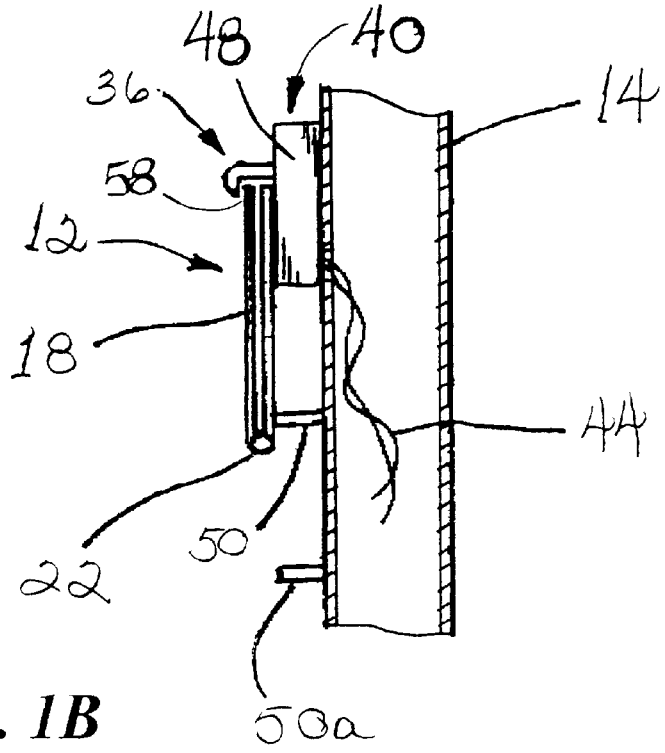
FIG. 1B is a side elevation view of the present device shown attached to a pole in a folded configuration, with the back surface of the pivotable section of the placard disposed to display a second sign item.

The present invention is a condition responsive traffic sign 10 for directing pedestrian and/or vehicular traffic. As shown in FIGS. 1A and 1B, the traffic sign 10 is comprised of a vertically disposed placard 12, having a fixed section 16 and a pivotable section 18. Each section 16 & 18 of the placard 12 has a perimeter edge 20*a* and 20*b*, and a front surface 26 & 28 and a back surface 27 & 29 (see FIG. 2B). The two sections of the placard 12 are disposed one over the other. In the preferred embodiment shown in FIG. 1, the fixed section 16 of the placard 12 is the upper section. The section 16 is fixed in that it is the section of the placard 12 that is attached to the pole, standard or other mount 14 on which the device 10 is posted. The pivotable section 18 of the placard 12 is the lower section. The fixed section 16 and pivotable section 18 pivotably communicate with each other at their perimeter edges 20*a* & 20*b*.

A pivot mechanism 22 connects the perimeter edge 20*a* at the bottom of the fixed section 16 with the perimeter edge 20*b* at the top of the pivotable section 18. The pivot mechanism 22 allows the front surface 28 of the pivotable section 18 to rotate and fold flat against the front surface 26 of the fixed section 16.

A catch mechanism 36 is disposed to releaseably engage the pivotable section 18 and hold the front surface 28 of the pivotable section 18 against a bias and flat against the front surface 26 of the fixed section 16. When so engaged, the catch mechanism 36 prevents the pivotable section from unfolding under the force of the bias.

Figure 2B:
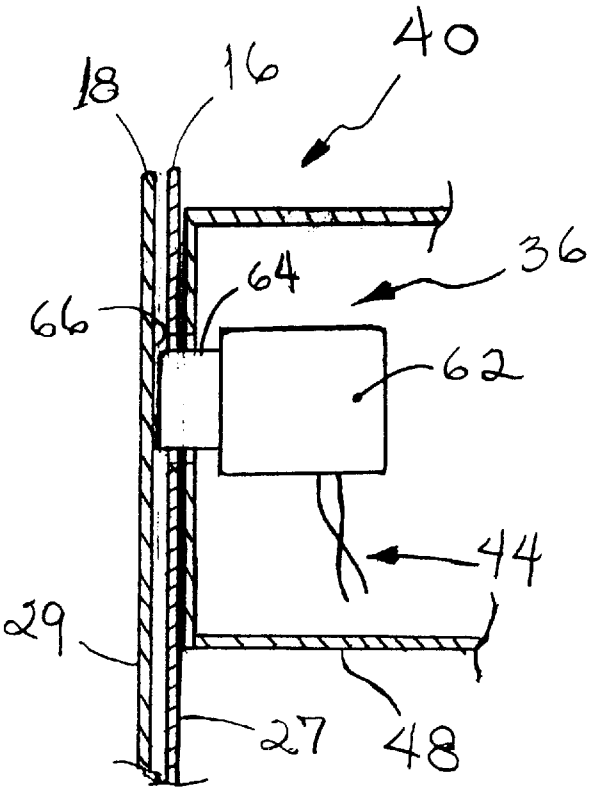
FIG. 2B is a partial cross-sectional view of the folded placard and controller housing showing an electrically operated catch mechanism.
Figure 2A:
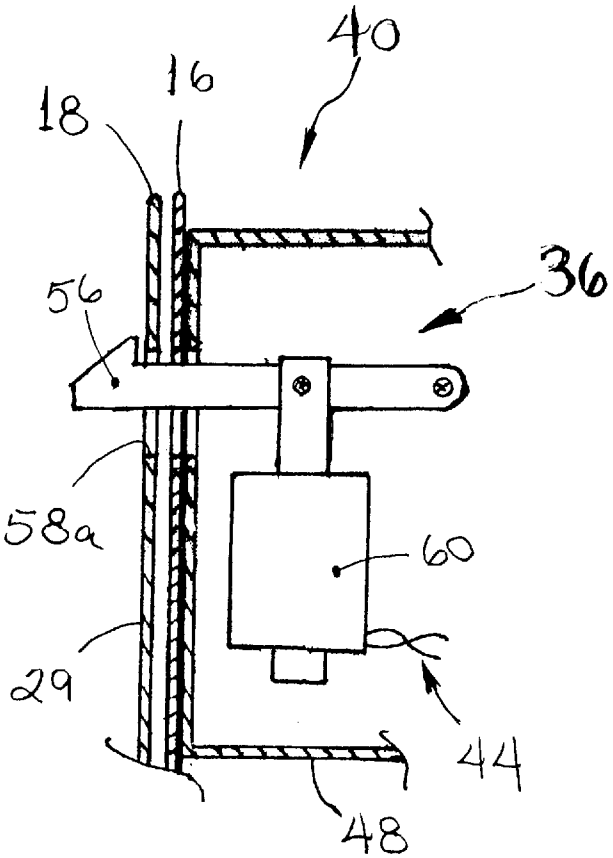
FIG. 2A is a partial cross-sectional view of the folded placard and controller housing showing an electro-mechanically operated catch mechanism.

As shown in FIGS. 2A and 2B, a controller 40 is attached to the back surface 27 of the fixed section 16 of the placard 12. The controller 40 may be mechanically operated, electrically powered, or a combination of the two. The controller 40 senses when a condition to which the sign 10 is responsive occurs, and then releases the catch mechanism 36 from holding the pivotable section 18 of the placard 12 against the fixed section 16. This allows the pivotable section 18 to unfold under the force of the bias to display the front surfaces 26 & 28 of both sections of the placard 12 substantially aligned in a vertical plane. In an embodiment wherein the controller 40 of present traffic sign device 10 is electrically powered, an electrical connection 44 to an external power source (see FIG. 2B) can be operatively connected to the controller 40.

At least one mounting means is disposed on the back surface of the fixed section 16 of the placard 12 to attach the present device 10 to a post, pole or other standard 14 for displaying the sign to traffic. In the preferred embodiment shown in FIGS. 1A & 1B, one mounting means is the controller housing 48 which contains the components of the controller 40. As shown, the controller housing attaches the fixed section 16 of the placard 12 in a proximately vertical orientation to the pole standard 14. A standoff 50 is used as an additional mounting means to attach the fixed section 16 of the placard 12 to the pole standard 14. A second standoff 50*a* is used as a stop to limit the amount the pivotable section 18 of the placard 12 can unfold. If desired, a latch (not shown) can be incorporated into the stop to releasably catch and hold the unfolded pivotable section more securely in place, e.g., to prevent its banging or flapping in the wind.

Figure 3:
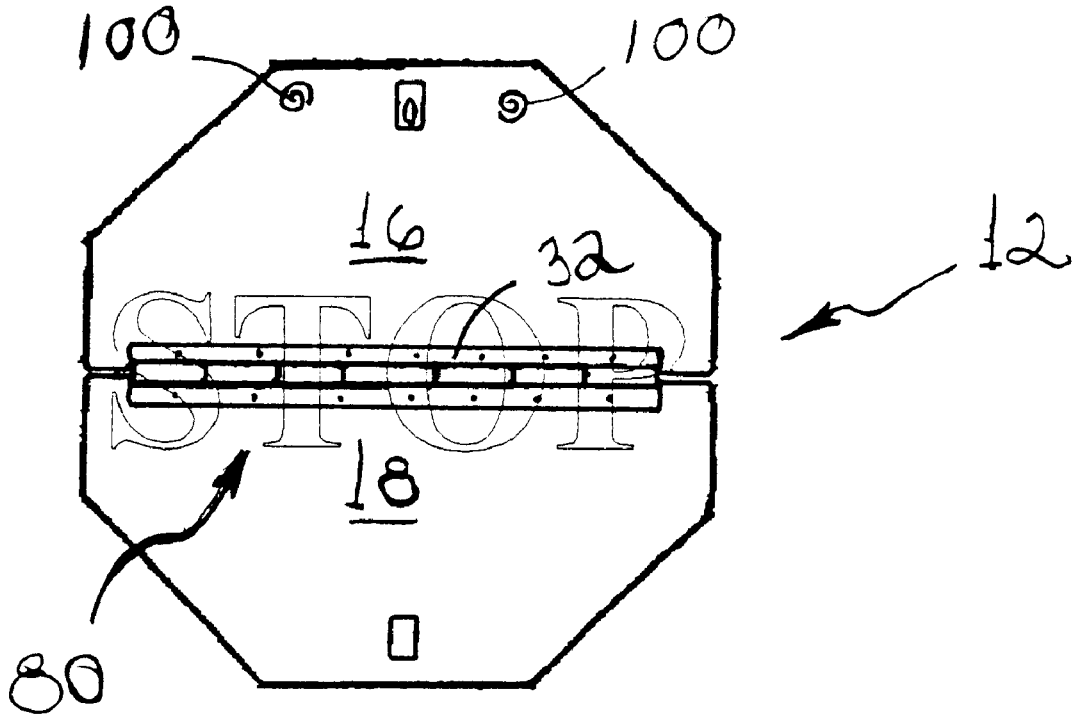
FIG. 3 is a front elevation view of an unfolded placard of the present invention showing a pivot mechanism practiced as a strap hinge, and displaying a first sign item on the front surfaces of the placard sections.

As shown in FIG. 3, unfolding the placard 12 causes the front surfaces 26 & 28 of the fixed and pivotable sections 16 & 18 together to display a first sign item 80. However, when the placard 12 is in its folded configuration, it is the back surface 29 of the pivotable section 18 that is presented and can display a second sign item 82 (see FIG. 6). A sign item is the message or symbol displayed on the surface of a sign section that conveys information to an observer. Therefore, alternative sign items may be displayed, depending on whether the sections 16 & 18 of the placard 12 are folded or unfolded.

The pivot mechanism 22 may be accomplished by any means that allows the pivotable section 18 of the placard 12 to fold against and unfold from the fixed section 16. Such means are known to and practicable in the present device 10 by one of ordinary skill in the art. Examples of such pivot mechanisms 22 include the fixed and pivotable sections 16 & 18 of the placard 12 being interconnected by at least one mutual rod 24 about which the sections are rotatable (see FIGS. 1A & 1B). It can be as simple as ring-linked adjacent holes (not shown) through the juxtaposed perimeter edges of the two sections 16 & 18 of the placard 12. The pivot mechanism 22 further comprises a least one hinge interconnecting the fixed and pivotable sections 16 & 18 of the placard 12, such as a strap hinge 32 (see FIG. 3) or one or more spring biased hinges 34 (see FIG. 10A). In a preferred embodiment, a biasing means is included with the device to facilitate the unfolding of the sections 16 & 18 of the placard 12. A biasing means may be incorporated into the pivot mechanism 22, such as one or more spring biased hinges 34, or other biasing means as known to the ordinary skilled artisan.

The biasing means provides for the unfolding of the pivotable section 18 of the placard 12 relative to the fixed section 16. Other means for biasing the unfolding of the pivotable section 16 relative to the fixed section 18 are anticipated in the present device 10. The purpose of this biasing means is to facilitate the initial unfolding of the two sections 16 & 18 of the 12 placard relative to each other. If the device 10 has not been activated in a long time, or if the device 10 has been subjected to inclement weather, the pivot may not operate as freely as desired. Where an accumulation of dirt or corrosion or the icing of the folded surfaces has occurred, an initial bias to facilitate operation of the pivot mechanism 22 could be beneficial to break any adhesion of the folded surfaces and facilitate the unfolding of the placard 12.

In the preferred embodiments exemplified in FIGS. 2A & 2B respectively, the catch mechanism 36 can be mechanical or electromagnetic. The catch mechanism 36 comprises a latch and catch combination. A latch 56/64 component of the combination is mounted (directly or indirectly) to one section of the placard 12, and a catch 58/66 is mounted on or incorporated into on the other placard section. The latch 56/64 on the one section is disposed to releaseably engage the catch 58/66 on the other section, and prevent the rotation of the sections about the pivot mechanism 22. Preferably, the latch 56/64 is mounted on the fixed section 16 of the placard 12 and the catch on or to the pivotable section 18. The catch mechanism 36 may be operated electrically, mechanically or electro-mechanically to cause the latch 56/64 to disengage the catch 58/66. Examples of catch mechanisms 36 adaptable for practice in the present invention include catch and pawl combinations, which may be either mechanically or electro-mechanically operated (see FIG. 2A), and electrically operated (see FIG. 2B).

Catch mechanisms 36 are the releasable combination of a latch and catch. For example, the perimeter edge 20*b* of the pivotable section 18 of the placard 12 may serve as a catch 58, as shown in FIG. 1B. In a similar fashion, the edge of an aperture can serve as a catch 58*a*, as shown in FIG. 2A. Alternatively, for a catch mechanism that utilizes an electromagnetic latch 64 as shown in FIG. 2B, the catch 66 is a portion of the surface of the placard section 18 that is paramagnetic and attractable to the electro-magnetic latch 64.

Figure 4A:
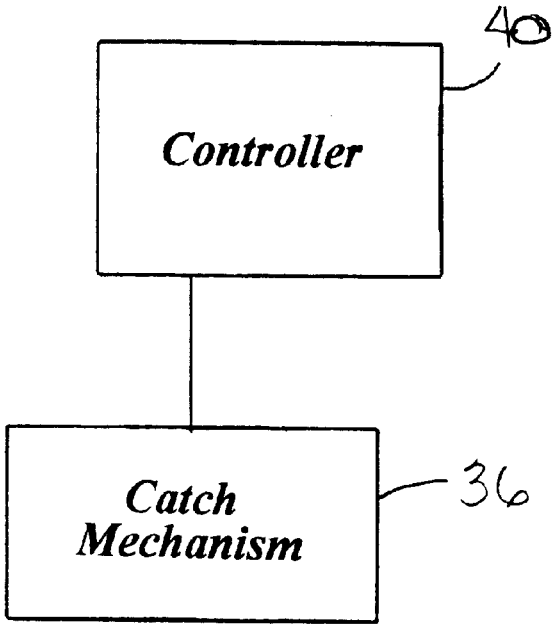
FIG. 4A is a block diagram of the simplest relationship of a controller to a catch mechanism, such as might be found in a mechanical controller and a mechanically operated catch mechanism.
Figure 5A:
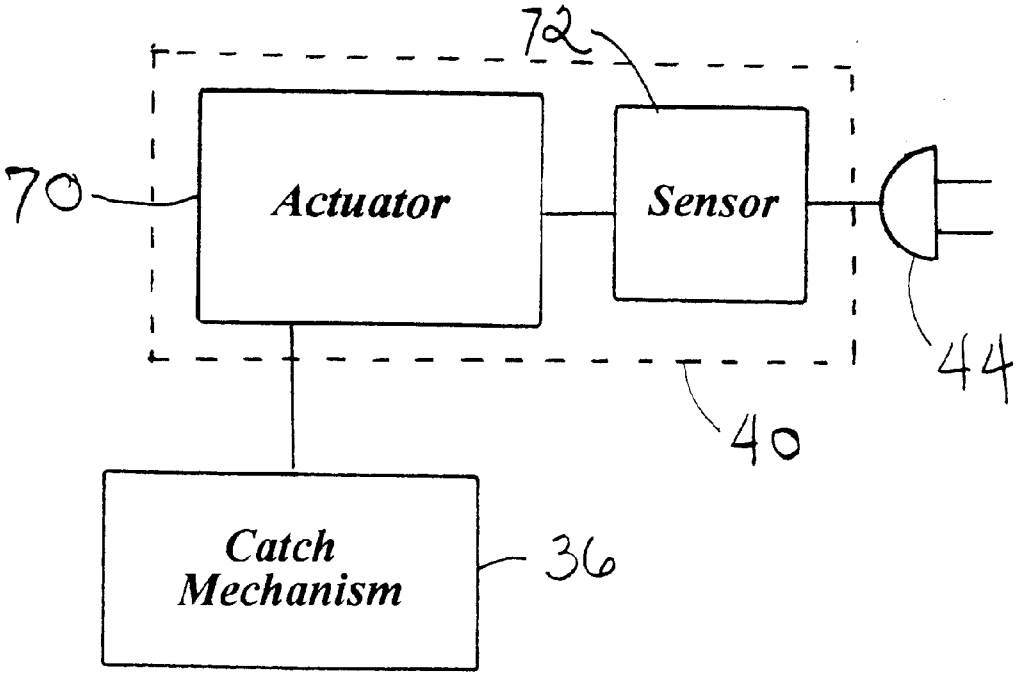
FIG. 5A is a block diagram showing the actuator and sensor features of a controller of the present invention, and its relationship to a catch mechanism, and an external power source.
Figure 4B:
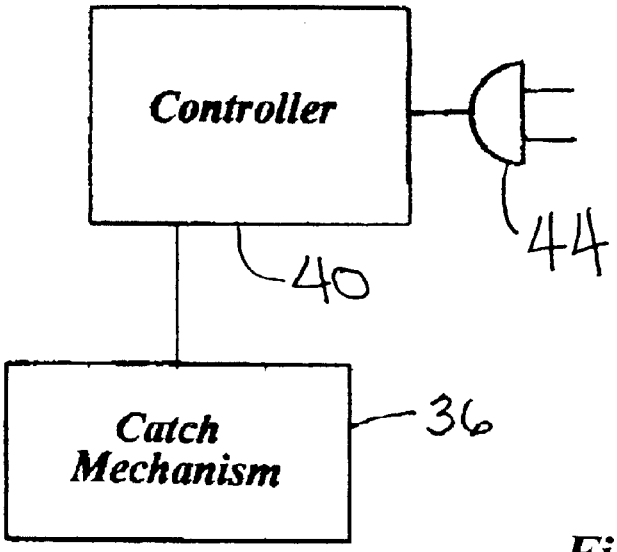
FIG. 4B is a block diagram of the relationship of an electrical or electro-mechanical controller to an electrically or electro-mechanically operated catch mechanism.

As shown in FIG. 4A, the controller 40 communicates with the catch mechanism 36. The controller 40 detects or senses the condition to which the sign device 10 is responsive and activates the catch mechanism 36. The controller 40 can inherently detect certain conditions, such as the loss or return of power at an electrical connection 44 to an external power source, and activate the catch mechanism 36, see FIG. 4B. Alternatively, the controller 40 has its actuator 70 feature in combination with a detector or sensor 72 for this purpose, as shown in FIG. 5A. The controller 40 is in operative communication with the catch mechanism 36 and acts to release the catch mechanism 36 upon detecting the condition to which the device 10 is responsive. Where the controller 40 comprises an actuator/sensor combination, the actuator 70 is in operative communication with the sensor 72 and the catch mechanism 36, with the actuator 70 disposed to release the catch mechanism 36 in response to the sensor 72 detecting a condition to which the sign device 10 is responsive. In any case, upon initially detecting the condition, the controller 40 releases the catch mechanism 36 and allows the pivotable section 18 to unfold to display the front surfaces 26 & 28 of both sections 16 & 18 of the placard 12. The controller 40 may be operated mechanically or electro-mechanically, depending on the condition to which the controller 40 is responsive and the design of the detector/sensor 72.

The present condition responsive traffic sign 10 detects and responds to certain changes in the environment of the sign 10. Depending on the type of controller 40 utilized, the device 10 detects one or more changes in the environment of the sign 10 related to: temperature, electrical power, signal transmission, moisture and water level, and respond by causing the catch mechanism 36 to operate. For example, the controller 40 may detect or sense a loss of electrical power, a drop in temperature below freezing, moisture (precipitation) or water (flooding) in the environment, or the presence of an activation signal transmission.

Figure 6:
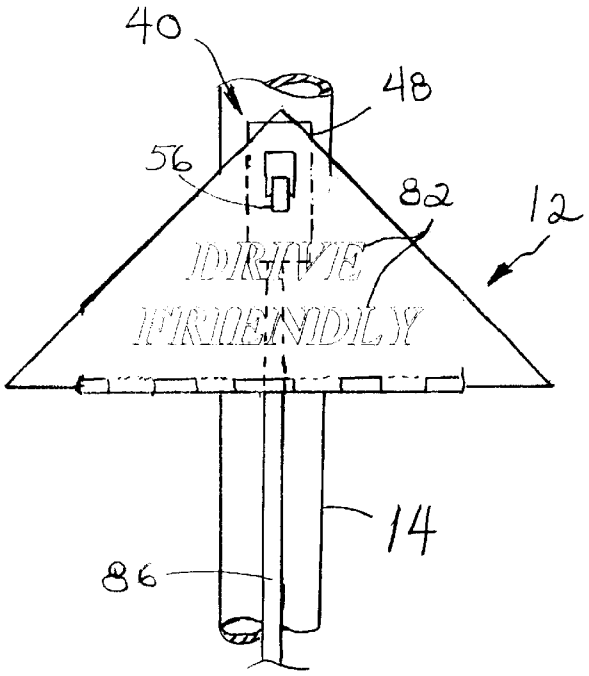
FIG. 6 is a front elevation view of a sign device of the present invention shown attached to a pole in an folded configuration, with back surface of a placard section displaying a second sign item. Also exemplified is a connection from a mechanical controller to a mechanically operated catch mechanism.
Figure 7B:
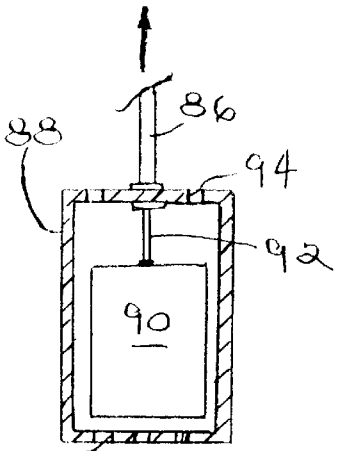
FIGS. 7A and 7B are cross-sections of a mechanical controller housing extension that is a float chamber containing a float assembly, and exemplifying how a mechanical controller may be accomplished in the present device to detect flooding in its vicinity.
Figure 7A:
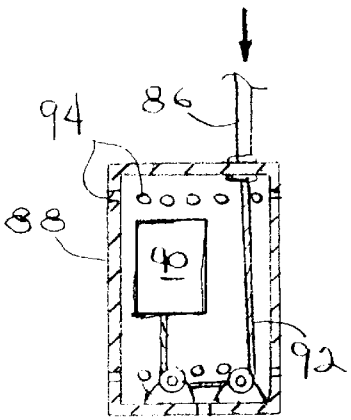

FIG. 6 is an example of the sign device 10 embodying a mechanical controller 40 and mechanically operated latch 56 for detecting flooding in the vicinity of the sign 10. The housing 48 of the controller 40 has an extension 86 communicating with a separate float chamber 88 containing a float 90. A float link 92 at its lower end connects the float 90 with the latch 56 of a catch mechanism 36. The float link 92 may be a flexible line or cable as shown in FIG. 7A and exert a downward force (see arrow) on the float link 92. Alternatively, the float link 92 may be a flexible rod as shown in FIG. 7B, and exert an upward force (see arrow) on the link 92. The controller extension 86 is made of tubing or other suitable material for slidably containing the float link 92. The float chamber 88 is open to the environment so that flood water may freely access the chamber 88. If such access is not otherwise provided, apertures or perforations 94 are used to vent the float chamber 88.

Figure 8A:
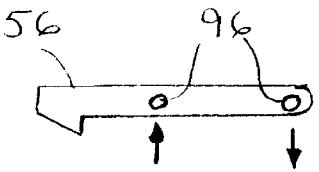
FIGS. 8A and 8B are side views of a latch pawl demonstrating how the pawl may be operatively oriented to response to a particular force vector relative to its fulcrum point.
Figure 8B:
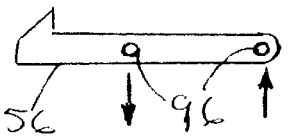

Using the illustration of a catch mechanism 36 of FIG. 2A, the float link 92 attaches at its upper end to the latch 56 of the catch mechanism 36 in a manner similar to that of the solenoid 60 shown. FIGS. 8A and 8B show different orientations of the latch 56, and different attachment points on the latch for connecting a float link 92 that exerts a specific force vector (see corresponding arrows in FIGS. 7A & 7B). The other attachment point 96 on the illustrated latch 56 is the fulcrum point for the lever action of the illustrated latch 56. Of course, other means of accomplishing a latch in the present catch mechanism 36 are known to and readily practicable in the present invention by one of ordinary skill in the art.

Figure 5B:
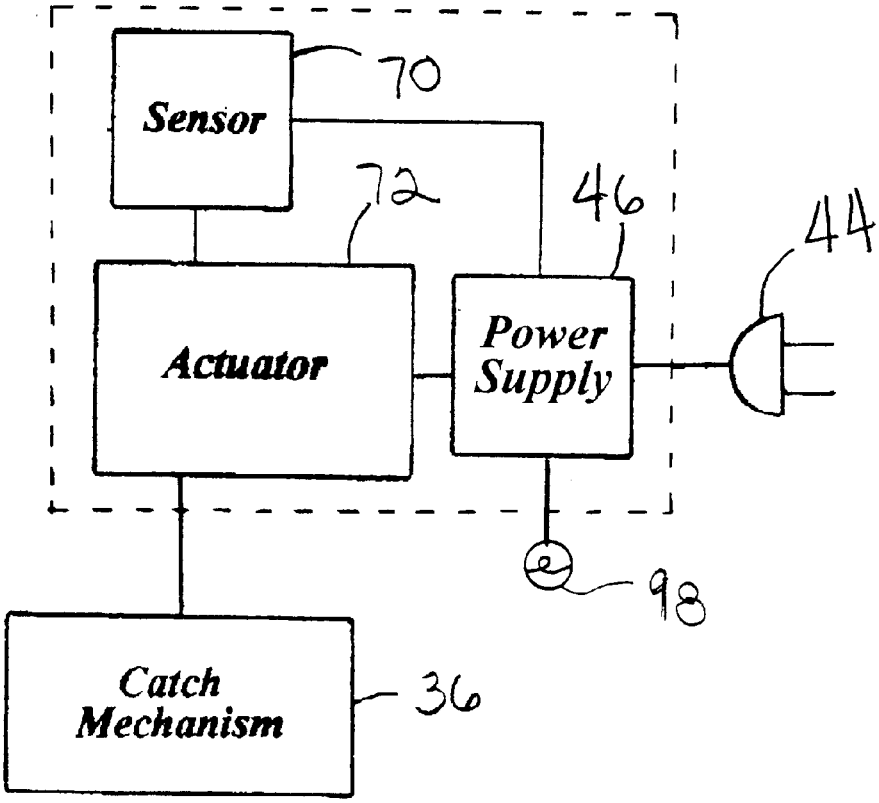
FIG. 5B is a block diagram showing actuator, sensor and internal power supply features of a controller of the present invention, and the controller's relationship to a catch mechanism and an external power source.

The controller 40 has a power source is in those embodiments of the sign device 10 wherein the controller is electrical or electro-mechanical. The power source can as simple as a connection 44 to an external electrical power line. However, as shown in FIG. 5B, in those embodiments wherein the controller 40 requires electrical power, it can further comprise an internal electrical power source 46 operative to energize those features and functions of the controller that require electricity. In the illustrated embodiment, the power supply 46 takes power from an external power electrical connection 44 and provides power to the sensor 70 and the actuator 72, and to a light source 98. In order to energize the light source (or any other electrical feature) in the absence of external power, the internal power supply 46 may include an internal power source comprising a charging/switching circuit and an electricity storage means, like a battery. Additionally, the internal power supply may include an internal power source which generates its own electricity in the absence of external power, such as a photovoltaic cells.

The present invention includes a means of mounting the sign device 10 to a pole 14, sign standard or other sign posting means. Mounting the sign device 10 to a pole standard 14 may be accomplished by utilizing any of a number of methods and fasteners known to one of ordinary skill in the art, including bolts, screws, straps and other types of fasteners. In the preferred embodiment shown in FIGS. 1A & 1B, the housing 48, which is attached to the back of the fixed section 16 of the placard 12, is used to mount or attach the sign device 10 to a pole standard 14 using fasteners 52. If needed, a fastener 52 is combined with a standoff 50 between the back surface of the fixed section 16 and the pole standard 14 to provide additional mounting support.

Because gravity provides bias for unfolding the sections 16 & 18 of the placard 12, the mounting means (which is the combination of the housing 48 and the standoff 50 in the embodiment shown in FIG. 1B) is disposed to mount the fixed section 16 of the placard 12 in an orientation that is sufficiently inclined from vertical to allow gravity to bias the pivotable section 18 to rotate away from the fixed section 16 when the catch mechanism 36 is released. If desired, to increase the biasing of the unfolding of the placard sections 16 & 18, the pivotable section 18 of the placard 12 may be weighted (not shown), spring loaded hinges 34 may be used for the pivot mechanism 22, or biasing springs 100 may be placed between the front surfaces 26 & 28 of the placard sections 16 & 18.

Figure 9:
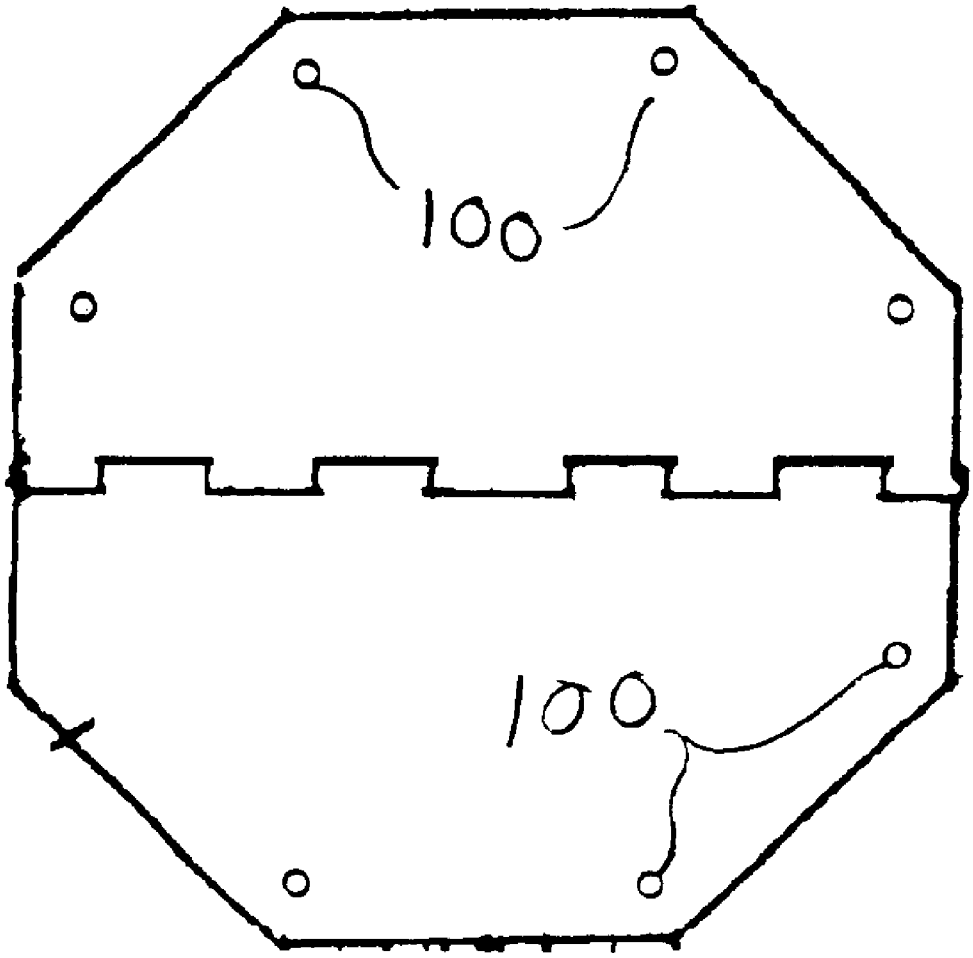
FIG. 9 is a front elevation view of an unfolded placard of the present invention showing an array of light sources displayed on the front surfaces of the placard sections.

Optionally, as shown in FIG. 9, the condition responsive traffic sign 10 can further comprises one or more electrically powered light sources 100 disposed on the front surfaces 26 & 28 of the placard 12. The light sources 100 are operatively connected to the internal power supply 46 of the controller. A switching circuit (not shown) in the power supply 46 controls the electrical power to the light source 100, illuminating them upon the controller 40 releasing the catch mechanism 36 by connecting the lights 100 to an internal power source.

Figure 10A:
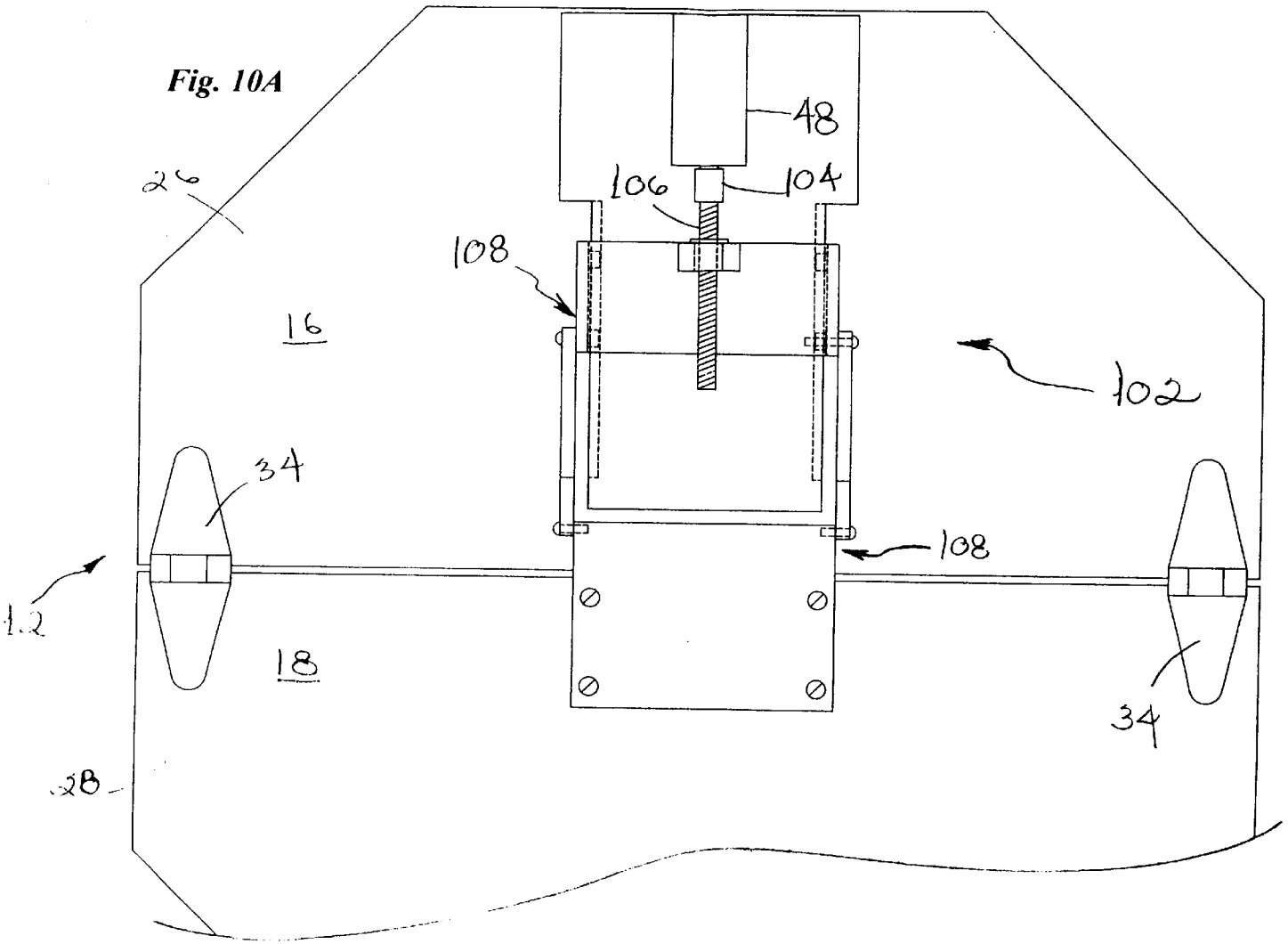
FIG. 10A is a partial rear elevation view of the back of a sign device of the present invention showing a controller having a folding mechanism. The motor assembly is contained within the controller housing and the folding mechanism is disposed on the back surfaces of the placard section. Also shown are spring biased hinges for facilitating the unfolding of the placard sections.
Figure 10C:
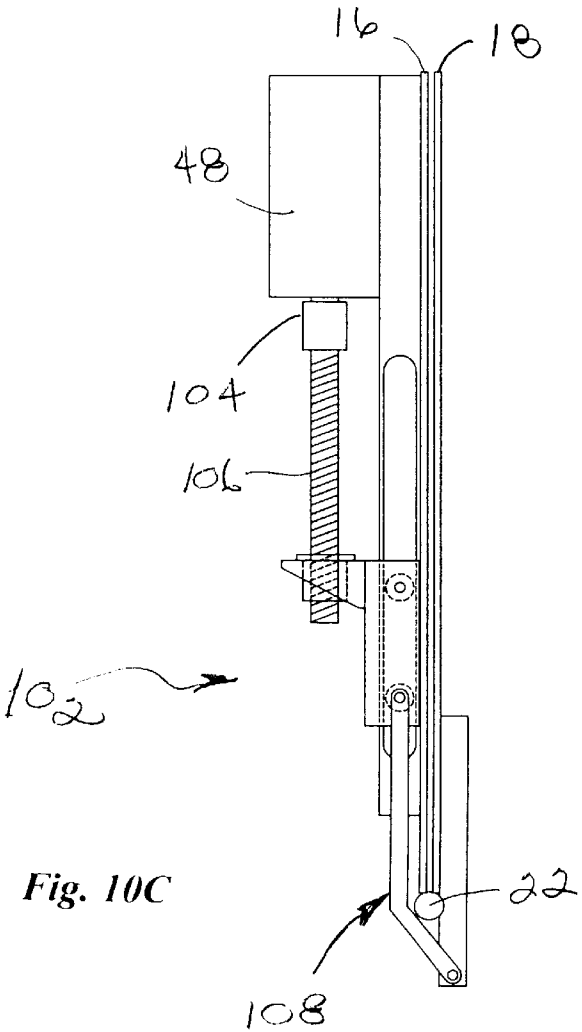
FIG. 10C is a side view of the placard and folding mechanism at a point when the placard sections are fully folded.
Figure 10B:
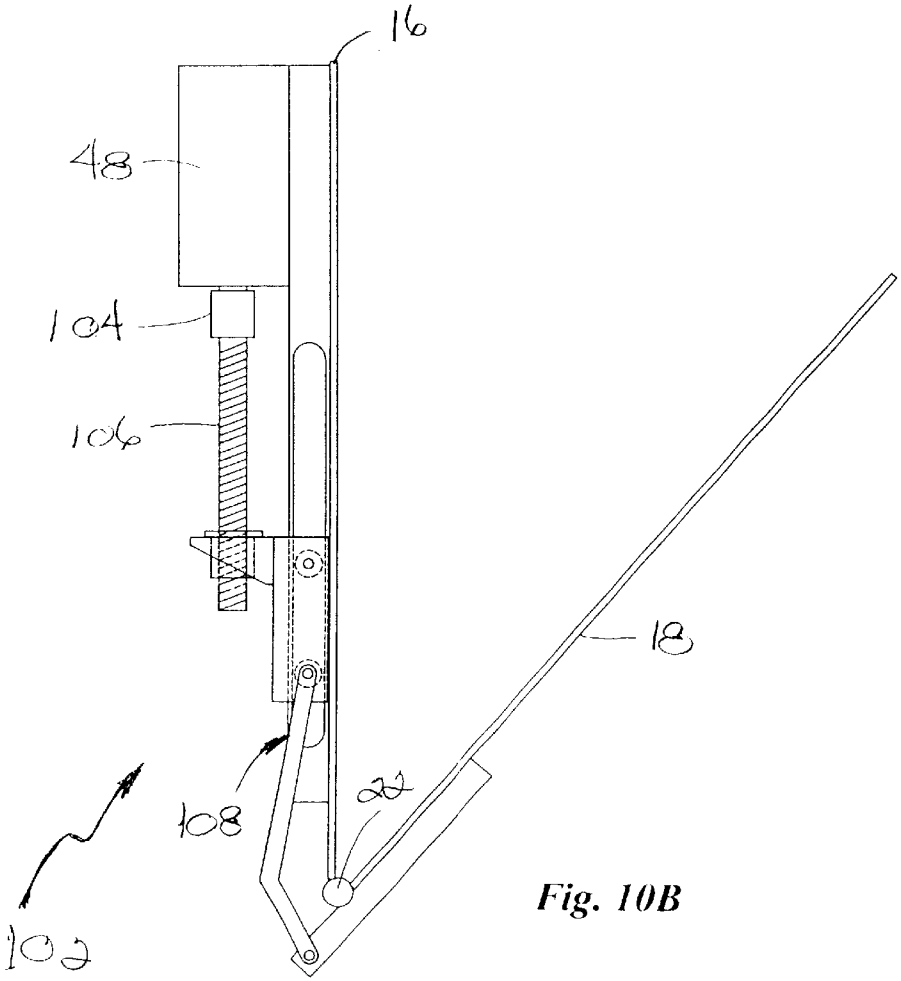
FIG. 10B is a side view of the placard and folding mechanism at a point when the placard sections are partially folded.
Figure 11:
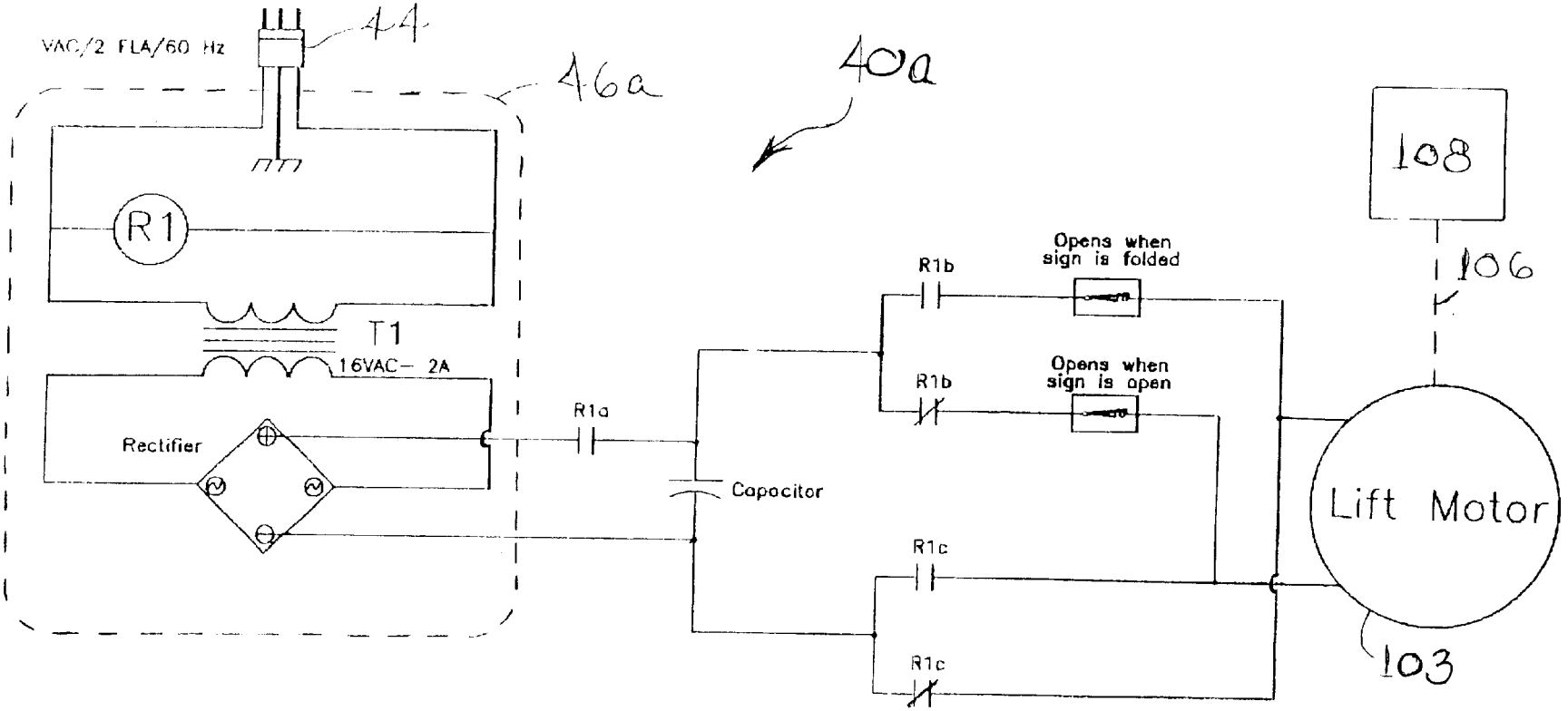
FIG. 11 is a schematic diagram of an electrical circuit practicable with controller having a motor driven folding mechanism.

As an additional option shown in FIGS. 10A to 10C, the controller 40*a* (see also FIG. 11) of the condition responsive traffic sign 10 further comprises a folding mechanism 102 to close the sign 10 by rotating the pivotable section 18 of the placard 12 flat against the fixed section 16. The folding mechanism 102 is activated upon termination of the condition to which the sign is responsive. Termination of the condition causes the internal power supply 46*a* to energize the folding mechanism 102, to which the power supply 46*a* is operatively connected. The folding mechanism 102 includes a drive motor 103, motor assembly 104 and drive mechanism 108 to rotate the pivotable section 18 and fold it flat against the fixed section 16, causing the catch mechanism 36 to re-engage. The motor assembly 104 is primarily contained in the controller housing 48. The drive shaft 106 of the motor assembly 104 extends from the housing 48 and is connected to the drive mechanism 108. The drive mechanism 108 is operatively attached to the back surfaces 26 & 28 of the placard sections 16 & 18.

While the above description contains many specifics, these should not be construed as limitations on the scope of the invention, but rather as exemplifications of one or another preferred embodiment thereof. Many other variation are possible, which would be obvious to one skilled in the art. Accordingly, the scope of the invention should be determined by the scope of the appended claims and their equivalents, and not just by the embodiments.

What is claimed is:

1. A condition responsive traffic sign for directing pedestrian and/or vehicular traffic comprising:

a vertically disposed placard having a fixed section and a pivotable section, each section having a perimeter edge, and a front surface and a back surface;

a pivot mechanism connecting a bottom perimeter edge of the fixed section with a top perimeter edge of the pivotable section, allowing the front surface of the pivotable section to rotate and fold flat against the front surface of the fixed section;

a catch mechanism disposed between the fixed section and the pivotable section to releaseably hold the front surface of the pivotable section against a bias flat against the front surface of the fixed section, preventing the pivotable section from unfolding under the force of the bias;

a controller fixed to the back surface of the fixed section for sensing the condition to which the sign is responsive, and for releasing the catch mechanism from holding the pivotable section flat against the fixed section and allowing the pivotable section to unfold under the force of the bias to display the front surfaces of both section of the placard, and wherein the condition to which the sign is responsive is a change in the environment of the sign; and a mounting means disposed on the back surface of the fixed section, the mounting means attaching the placard in a proximately vertical orientation to a standard.

2. The condition responsive traffic sign of claim 1, wherein the front surfaces of the fixed and pivotable sections of the placard together display a first sign item.

3. The condition responsive traffic sign of claim 1, wherein the back surface of the pivotable section of the placard displays a second sign item.

4. The condition responsive traffic sign of claim 1, wherein the pivot mechanism further comprises the fixed and pivotable section of the placard being interconnected by at least one mutual rod about which the section are rotatable.

5. The condition responsive traffic sign of claim 1, wherein the pivot mechanism further comprises a least one hinge interconnecting the fixed and pivotable sections of the placard.

6. The condition responsive traffic sign of claim 1, wherein the pivot mechanism further comprises a spring to bias the fixed and pivotable sections of the placard in an unfolded configuration.

7. The condition responsive traffic sign of claim 1, wherein the catch mechanism further comprises a latch mounted on one section of the placard and disposed to releaseably engage a catch on the other section of the placard and prevent the rotation of the section about the pivot mechanism.

8. The catch mechanism of claim 7, wherein the latch is mounted on the fixed section of the placard and the catch is on the pivotable section of the placard.

9. The catch mechanism of claim 7, wherein the latch is electrically operated to disengage the catch.

10. The catch mechanism of claim 7, wherein the latch is mechanically operated to disengage the catch.

11. The condition responsive traffic sign of claim 1, wherein the controller further comprises an actuator in operative communication with the catch mechanism to release the catch mechanism, and a sensor for detecting a condition to which the sign is responsive, the sensor in operative communication with the actuator and acting to cause the actuator to release the catch mechanism upon detecting the condition.

12. The controller of claim 11, wherein the sensor detects a condition selected from the group consisting of a change in temperature, electrical power, electrical parameter, signal transmission, moisture and water level, the sensor in operative communication with the catch mechanism and acting to release the catch mechanism upon detecting the condition.

13. The condition responsive traffic sign of claim 1, wherein the mounting means further comprises a fastener for attaching the fixed section to the standard.

14. The condition responsive traffic sign of claim 1, wherein the mounting means further comprises a fastener combined with a standoff for attaching the back surface of the fixed section to the standard.

15. The mounting means of claim 14, wherein the standoff further comprises a housing for containing the controller mechanism.

16. The mounting means of claim 14, wherein the standoff is disposed to mount the fixed section of the placard in an orientation that is sufficiently inclined from vertical to allow gravity to bias the pivotable section to rotate away from the fixed section when the catch mechanism is released.

17. The condition responsive traffic sign of claim 1, further comprising an electrical power source operatively connected to the controller to provide electrical power to energize those features and functions of the controller that require electricity.

18. The power source of claim 17, wherein the power source is selected from the group consisting of: a simple connection to an external electrical line, an internal power supply circuit, and a combination of the two.

19. The condition responsive traffic sign of claim 1, further comprising an electrically powered light source disposed on the front surface of the placard and operatively connected to the power source via the controller, the light source being energized upon the controller releasing the catch mechanism.

20. The condition responsive traffic sign of claim 1, further comprising a folding mechanism to rotate the pivotable section to fold flat against the fixed section and to engage the catch mechanism upon termination of the condition to which the sign is responsive, the folding mechanism operatively connected to the fixed and pivotable sections of the placard and to a power source.

* * * * *